US005205131A

United States Patent [19]

Powlas

[11] Patent Number: 5,205,131

[45] Date of Patent: Apr. 27, 1993

[54] REFRIGERATOR SYSTEM WITH SUBCOOLING FLOW CONTROL

[75] Inventor: Jerome D. Powlas, Maple Grove, Minn.

[73] Assignee: White Consoldiated Industries, Inc., Cleveland, Ohio

[21] Appl. No.: 867,281

[22] Filed: Apr. 9, 1992

Related U.S. Application Data

[63] Continuation-in-part of Ser. No. 671,390, Mar. 19, 1991, abandoned.

[51] Int. Cl.[5] ..... F25B 41/00

[52] U.S. Cl. ..... 62/203; 62/216

[58] Field of Search ..... 62/203, 222, 498, 214

[56] References Cited

U.S. PATENT DOCUMENTS

| | | | |
|---|---|---|---|
| 1,638,958 | 8/1927 | Preston | 236/99 X |
| 2,141,459 | 12/1938 | Bronaugh et al. | 62/229 |
| 2,221,062 | 11/1940 | Starr | 236/93 UX |
| 3,367,130 | 2/1968 | Owens | 62/222 |
| 4,788,828 | 12/1988 | Sato | 62/214 |
| 4,840,038 | 1/1989 | Sato | 62/210 |

FOREIGN PATENT DOCUMENTS 0255035 2/1988 European Pat. Off. .

*Primary Examiner*—William E. Wayner

*Attorney, Agent, or Firm*—Pearne, Gordon, McCoy & Granger

[57] ABSTRACT

A vapor compression refrigeration system for cooling a cabinet having a thermostat for cycling the compressor off and on to maintain a predetermined temperature range in the cabinet includes a subcooling flow control valve at the inlet to the capillary tube restriction. The valve is operated by a sealed bellows containing a refrigerant so that the valve is responsive to the fluid entering the valve. The valve is calibrated so that only a subcooled liquid refrigerant can flow through the valve and if the entering refrigerant is above a predetermined level the valve will close to completely block all flow between the condenser and the evaporator, and the valve will stay in the closed position at all times when the compressor is not running.

2 Claims, 3 Drawing Sheets

REFRIGERATOR SYSTEM WITH SUBCOOLING FLOW CONTROL

This is a continuation-in-part of application Ser. No. 07/671,390, filed Mar. 19, 1991, now abandoned.

BACKGROUND OF THE INVENTION

This invention relates to refrigeration systems, and more particularly to refrigeration systems used in household refrigerators and freezers.

Refrigeration systems for household refrigerators and freezers have heretofore been designed for low cost and high reliability, both of which require a simplicity of design, together with a minimum number of parts. Typical refrigerators or freezers employ a vapor-compression system having a fractional horsepower, electric motor driven, hermetic compressor connected in a circuit with a condenser, an evaporator, an optional accumulator, and a refrigerant flow restriction between the condenser and the evaporator. For reasons of obtaining high energy efficiency, it is desirable to utilize a relatively high duty cycle for the compressor run time, while maintaining a sufficient reserve for high ambient temperature conditions. Thus, a thermostat responsive to the temperature in the cooled cabinet is used to cycle the compressor as necessary to maintain the preselected temperature. Based on normal room temperatures and the absorption of heat into the cooled space through the insulation, the compressor duty cycle may run fifty percent to sixty percent, leaving a reserve but requiring continuous operation under very high ambient temperatures or frequent opening of the door for access to the interior of the cooled cabinet.

The flow restriction has been almost universally a capillary tube sized for optimal efficiency at a single set of conditions of ambient and internal cabinet temperature. Capillary tubes used as the sole restriction offer the advantages of low cost, high reliability, and the added efficiency of being easily placed in heat exchange relationship with the return line from the evaporator to the compressor.

The capillary tube system, which runs constantly at a single ambient temperature and constant load condition, is very efficient when the capillary tube is sized for these conditions. When this is done and the system is operating under equilibrium conditions, the refrigerant at the condenser outlet where it enters the capillary tube is a saturated or slightly subcooled liquid. This liquefied refrigerant flows through the capillary tube and undergoes a substantial pressure reduction until it enters the evaporator, where it is vaporized to absorb heat from the interior of the refrigerator or freezer.

Because the refrigerant flows in a closed system, and the actual rate of flow through the capillary tube is dependent upon the pressure differential between the pressures in the condenser and the evaporator, any change in load conditions will affect the operation of the system. In the case of refrigerators and freezers, the changes in operating conditions can result from changes in the room ambient temperature, which affects the heat dissipation from the condenser, as well as the internal conditions, which may be determined by the opening and closing of the door and the addition of warm items to affect the load on the evaporator. Furthermore, because the system must operate on a cyclic basis to maintain reserve capacity for extreme conditions, a thermostat inside the refrigerator causes the compressor to cycle on and off, and when the compressor is off, the pressure tends to equalize throughout the system, resulting in the elimination of liquid refrigerant in the capillary tube, which then becomes entirely filled with gas. The result of these changes in operating condition is that the refrigeration system is often operating under conditions other than optimum with regard to the temperatures and pressures in the condenser and the evaporator, causing a loss of energy efficiency in the system.

Some of these effects can be minimized in various ways. For example, to minimize the formation of flash gas in the capillary tube, which would tend to reduce the capacity of the system, the tube is usually soldered or otherwise placed in heat transfer relationship with the return line from the evaporator to the compressor. Because the common optimum conditions are such where the system operates at say a fifty percent duty cycle, the capillary tube is usually sized "loose" or with a reduced restriction which allows fast flooding of the evaporator during start-up and fast equalization of suction and discharge pressure during the OFF portion of the cycle.

The fast flooding of the evaporator allows the system to quickly reach a high running efficiency, thereby reducing the total compressor run time for the ON cycle. Once the evaporator is flooded, however, this type of system tends to allow gas to enter the capillary tube and pass directly into the evaporator. When gas passes from the condenser to the evaporator, it never goes through the phase change to a liquid and back to gas that is necessary to produce effective cooling in the evaporator. Not only does this load the compressor with an increased mass flow that does not refrigerate, but it also transports heat into the evaporator, to thereby reduce the efficiency of the system. When the compressor is turned off at the end of the run cycle, the pressure equalizes between the condenser and the evaporator across the capillary tube relatively quickly, and this allows hot gas and liquid to pass into the evaporator. This adds heat to the evaporator and decreases overall system efficiency. The fast equalization, however, allows a lower cost, split phase compressor motor, with its relatively low starting torque, to restart after short OFF cycle.

On the other hand, if the system uses a "tight" or more restrictive capillary tube, the system will tend to have a slightly greater efficiency during steady state run conditions, but the evaporator floods so slowly during start-up that the advantage in efficiency may be lost over the entire run cycle. Furthermore, equalization may take so long that the compressor may have starting difficulties with a short OFF cycle because the low starting torque is unable to overcome the remaining back pressure in the condenser.

In larger refrigeration systems, these problems are overcome by using a controlled expansion valve as the restriction instead of the capillary tube. Valves of this type generally use a diaphragm or bellows operated by a refrigerant system and opens or closes the valve located at the evaporator inlet to vary the amount of restriction at this point. For example, Owens U.S. Pat. No. 3,367,130 discloses an expansion valve which opens and closes in response to the amount of subcooling of the refrigerant leaving the condenser by responding to a sensor attached to the external surface of the tube at that point, which as disclosed is remote from the valve itself. However, valves of this type are too large and much too expensive to be substituted for a capillary tube in small refrigeration systems.

In the completely different area of refrigeration for automotive air conditioning, it has been proposed to provide a subcooling flow control valve to control refrigerant flow to the evaporator in conjunction with an additional downstream flow restrictor, such as an orifice. European Patent Publication No. 255,035, published Feb. 3, 1988, shows a flow control valve with an external bulb used in an automotive air conditioner with a downstream restriction that may be a capillary or an orifice. U.S. Pat. Nos. 4,788,828 and 4,840,038, both in the name of Motoharu Sato, both disclose control valves using an internal sealed bellows filled with a refrigerant for controlling flow to a downstream restriction in an automotive air conditioning system. The first of these patents shows a bleed passage bypassing the valve to allow equalization when the compressor is turned off. The second patent uses a second bellows downstream of the valve to expand and force open the valve closed by the first bellows, to allow equalization to take place across the valve. All of these arrangements are intended for automotive air conditioning where the engine provides sufficient power for the compressor under all conditions, and the purpose of the valve is to regulate flow under a wide range of flow rates resulting from widely varying engine, and hence compressor, speeds.

SUMMARY OF THE INVENTION

The present invention provides an improved and more efficient refrigeration system for household refrigerators and freezers using a capillary tube restriction by adding a novel subcooling flow control valve between the condenser outlet and the entrance end of the capillary tube.

The flow control valve is an internally self-contained unit which modulates the flow proportional to the amount of subcooling in the refrigerant flowing through the valve. The valve is set to close completely when the amount of subcooling is reduced below a minimum specified positive value, and will remain closed when the compressor is turned off to prevent equalization of the system and any flow of hot refrigerant into the evaporator. When the compressor starts, it must discharge into a condenser that is already at an elevated pressure because of the lack of equalization across the flow control valve. Although this pressure will have dropped below the normal operating pressure of the condenser as a result of cooling of the condenser during the OFF cycle, the compressor still requires a high starting torque motor but not one with a higher horsepower rating for run conditions. Higher starting torque can be provided by the use of a capacitor start motor. After the compressor restarts, the pressure in the condenser will rise until a subcooled liquid is present at the outlet. When the liquid at the outlet reaches the predetermined minimum specified positive subcooling value, the flow control valve will begin to open and allow refrigerant to flow to the capillary tube, and hence into the evaporator. The flow control valve provides increased flow as the amount of subcooling increases, and such increased flow will allow desirable flooding of the evaporator.

In this system, the capillary tube is sized as a significantly looser or less restrictive tube, and the pressure drop will be less than normal, with the rest of the drop taking place across the flow control valve. Thus, the pressure drop across the capillary tube will remain proportional to the mass flow rate of the refrigerant, while the pressure drop across the flow control valve will be inversely proportional to the mass flow rate, since the valve opens more with increased mass flow which tends to be proportional to the amount of subcooling of the refrigerant at the outlet of the condenser. Since the flow control valve will close before the amount of subcooling at the condenser outlet drops below the minimum specified value, at no time during the cycle of operation of the system will gas enter the capillary tube.

The flow control valve is a self-contained unit which is responsive to the subcooling of the refrigerant actually flowing through the valve. According to the preferred embodiment of the valve, the housing has an inlet connected to the outlet of the condenser and an outlet connected to the inlet end of the capillary tube, leading in turn to the evaporator, and this housing defines a first chamber between the inlet and the outlet. A movable wall member in the form of a sealed bellows is mounted in this first chamber between the inlet and outlet. The portion or end adjacent the inlet is fixed with respect to the housing, while the opposite or movable portion or end carries a valve element. A valve seat is mounted on the housing adjacent the outlet and is engageable by the valve element to seal and prevent any flow of refrigerant from the inlet to the outlet when the valve is fully closed. The interior of the bellows defines a second chamber which is filled with a refrigerant in a saturated state, and the refrigerant may be either the same as that in the system or a fluid which has a greater saturation pressure than that of the refrigerant in the system. To allow better response, the second chamber includes a tubular portion extending back into the inlet tube and exposed to the incoming refrigerant to ensure the most effective heat transfer between the system refrigerant and that in the second chamber, so that the second refrigerant and temperature will closely track that in the first chamber.

The minimum specified subcooling value or set point must be selected to be high enough in terms of the subcooling pressure in the surrounding refrigerant in the first chamber to ensure that the valve never opens unless there is a subcooled liquid in the first chamber and always closes before any gas can enter the capillary tube. On the other hand, the set point cannot be too high or there will be difficulty in promoting the initial flow as the valve opens after the system has started.

DESCRIPTION OF THE PREFERRED EMBODIMENTS

Figure 1:
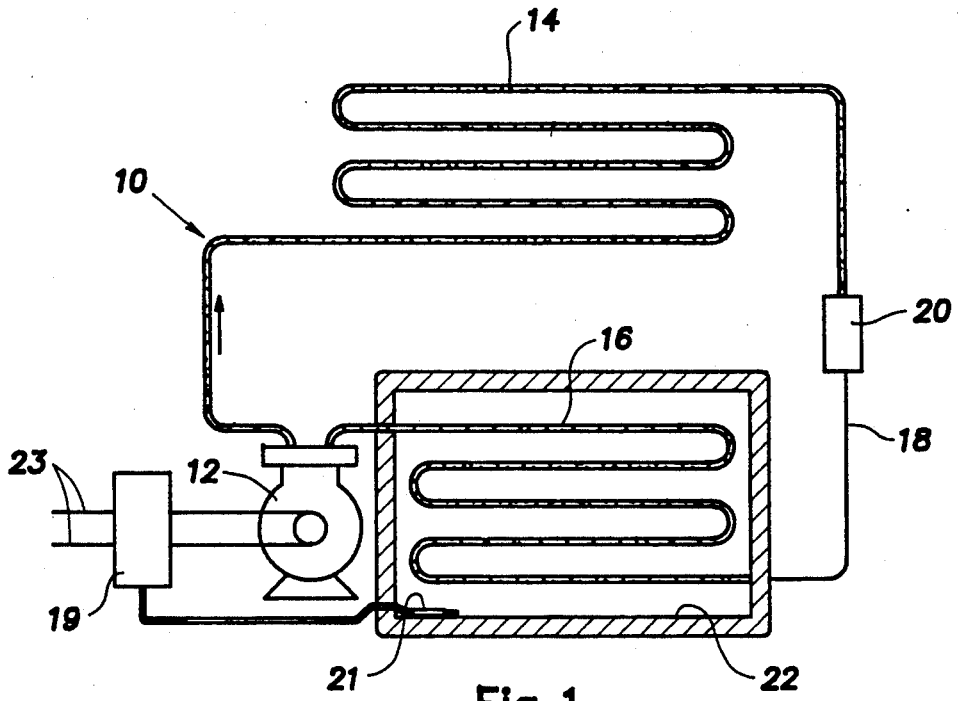
FIG. 1 is a schematic representation of a refrigeration system incorporating a flow control valve constructed according to the present invention.
Figure 4:
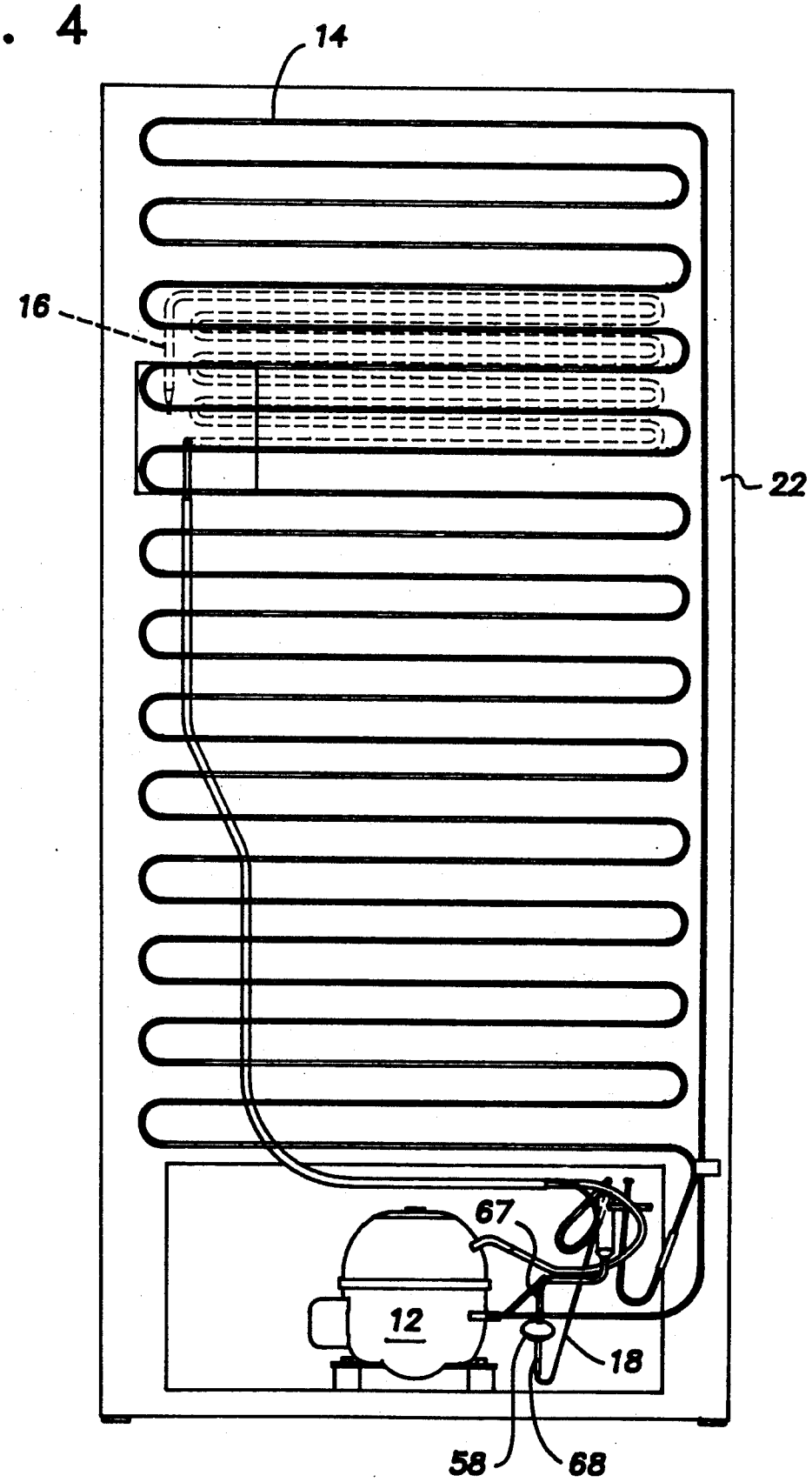
FIG. 4 is a rear elevational view of a refrigerator incorporating the invention.

Referring now to the drawings in greater detail, FIG. 1 is a schematic illustration of a vapor compression refrigeration system 10 which is typically used in the household refrigerator or freezer. The system 10 includes an electric motor-driven compressor 12, preferably of the hermetic type, having an output connected to a condenser 14, and an evaporator 16 which is mounted inside of an insulated compartment 22 and the return from the evaporator 16 is connected back to the inlet of the compressor 12. This system is a closed recirculating system filled with a suitable refrigerant such as R12 and, to provide the necessary flow restriction between the condenser 14 and the evaporator 16, typically a capillary tube 18 is used as the expansion controlling device. As shown in FIG. 4, typically the capillary tube 18, which is carefully sized to a given internal diameter and length, is connected in heat conducting contact with the line between the compressor 12 and the condenser 14. In accordance with the present invention, a control valve 20 is connected in the line between the condenser 14 and the entrance end of capillary tube 18.

In order to maintain the compartment 22 at desired temperature, suitable thermostat 19 is provided to operate responsive to a sensing bulb 21 placed within the compartment 22 to sense its temperature. The thermostat 19 operates through electrical contacts which connect or disconnect the electrical supply from supply lines 23 to the electric motor driving the compressor 12. Thus, when the temperature sensed by the bulb 21 rises to a predetermined level as the result of heat influx into the compartment 22, the contacts in thermostat 19 will close to energize the compressor 12 for a length of time until the compartment 22 drops to a lower temperature, which allows the thermostat 19 and compressor 12 to cycle off until the temperature again rises to the predetermined level.

It will be understood that the length of time that the compressor 12 is running, the duty cycle, depends upon the ambient temperature surrounding the compartment 22, and the other components of the system, as well sa other factors such as the thermal mass inside the compartment 22 and the number of times any access door is opened and closed to allow admission of the warmer external air. Thus, under most conditions, the system is sized so that the compressor will have a duty cycle or run time of approximately fifty percent, but this can rise, particularly when door openings and closings occur often or there is a high ambient temperature. Likewise, if the refrigerator or freezer is placed where the ambient temperature is low, the duty cycle may be much lower.

Figure 2:
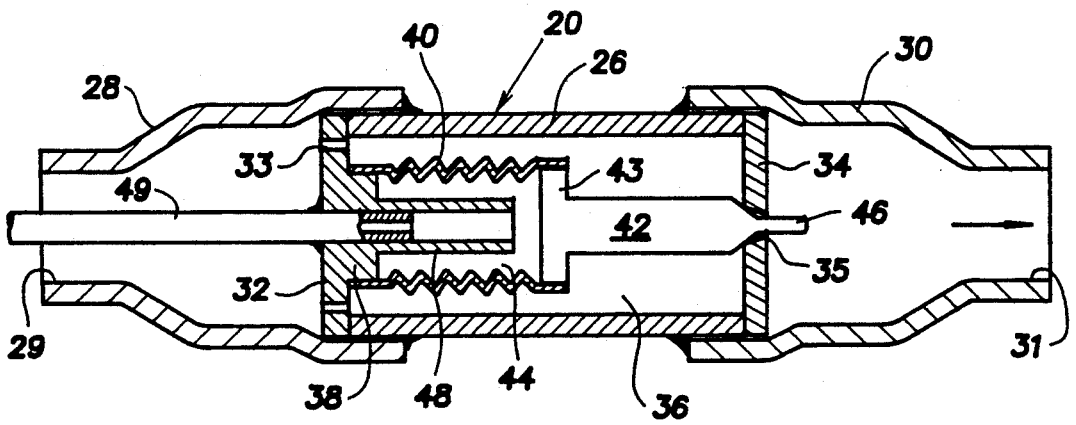
FIG. 2 is a cross-sectional view of one preferred flow control valve constructed according to the present invention.

One embodiment of the control valve 20 is shown schematically in FIG. 2 in longitudinal cross section. The valve 20 includes a short tubular valve housing 26 having an inlet fitting 28 welded or soldered to one end and defining a reduced diameter inlet opening 29 which is connected to the tubing from the condenser 14. At the other end is an outlet fitting 30 which may be similar to inlet fitting 28 and has a reduced outlet opening 31 which is, in turn, connected by a suitable fitting to the inlet end of the capillary tube 18.

The internal mechanism for the control valve 20 is shown in generally schematic arrangement, and includes an inlet plate 32 extending across the inlet side of the housing 26 and having a plurality of inlet openings 33 extending therethrough and providing sufficient area to allow free flow of the refrigerant from the inlet fitting 28 into the interior chamber 36 of housing 26. At the other end, the chamber 36 is closed off by an outlet plate 34 extending across the housing 26 in sealing relation and defining a valve seat 35 at its central opening in coaxial alignment with the inlet fitting 28 and the outlet fitting 30.

Thus, a first chamber 36 is defined by the valve housing 26 and the two plates 32 and 34, and the operating valve mechanism is located in this chamber. A boss 38 is formed on the side of inlet plate 32 within chamber 36, and serves as a set for one end of an elongated bellows 40, whose other end is closed off by a base 43 of valve member 42, which in turn has a tip 46 adapted to engage the valve seat 35. The bellows 40 is designed to allow free longitudinal expansion so that the valve member 42 can move axially within the chamber 36 in a direction toward and away from the valve seat 35 carried on outlet plate 34. Thus, the bellows 40 defines within itself a second chamber 44 which is completely sealed from the first chamber 36, and is filled with a calibrated charge of a suitable refrigerant, which may be either the same refrigerant as is used in the system, such as R12, or one having a higher vapor pressure at the same temperature under saturated conditions, such as R500. The amount of this charge is calibrated to ensure that the valve is completely closed as long as the conditions in the first chamber are such that the amount of subcooling of the system refrigerant is below a predetermined minimum value or set point. Only when the subcooling exceeds the set point does the valve open to allow subcooled liquid refrigerant to enter the capillary.

It should be noted that a tubular portion 48 projects from the boss 38 and is engageable by the valve member base 43 under extremely low temperature conditions to limit the movement of the valve member 42 away from the outlet plate 34. An extension tube 49 is mounted within the tubular portion 48 and extends back through the inlet opening 29, where it is sealed and, therefore, made a part of the second chamber 44. The extension tube 49, by extending back through the inlet, is in thermal transfer contact with the incoming refrigerant to ensure that the temperature of the refrigerant within the second chamber 44 will track as closely as possible the temperature of the incoming system refrigerant, to ensure a minimum of delay in response time of the valve. It should also be noted that the valve member tip 46, which extends through the valve seat 35, may be configured to provide a varying orifice size with the valve seat 35 as the valve member 42 moves to different axial positions in response to pressure and temperature changes within the valve.

When the compressor 12 is off and has not been run for some time, the valve 20 is closed, with the valve member tip 46 in tight engagement with the valve seat 35 to positively prevent any flow of refrigerant from the inlet to the outlet, and hence from the condenser to the evaporator. When the compressor is started after an OFF cycle, it pumps residual refrigerant out of the evaporator and into the condenser to cause an increase in pressure within the condenser. Since the refrigerant at the outlet of the condenser is already at a relatively cool temperature, the increase in pressure which is reflected throughout the condenser results in a sub-cooling of the refrigerant at the condenser outlet and inlet to the control valve 20. This pressure increase will act on the refrigerant within the chamber 44, which will be retained at the same low subcooling temperature as the incoming refrigerant, causing the volume within the chamber 44 to decrease. This will cause the bellows 40 to shrink and move the valve member 42 toward the inlet so that the valve member tip 46 moves away from the valve seat 35 and the valve opens to allow refrigerant to begin to flow into the capillary, and hence to the evaporator. When the compressor initially starts, the opening of the valve member 42 will tend to be somewhat gradual, and there will be a substantial pressure drop across the valve so that only a portion of the total pressure drop between the condenser and evaporator will occur across the capillary tube 18. As the valve member 42 moves further away from valve seat 35, the resultant drop in restriction will decrease the pressure drop across the control valve 20 and increase the pressure drop across the capillary tube 18, and the total mass flow of refrigerant will increase. In cases where the evaporator may have warmed up to a temperature substantially above the normal operating temperature, as would be the case in a frost-free refrigerator or freezer after a defrost cycle in which the evaporator had been additionally heated by an electric defrost heater, the rate of flow of refrigerant will be at a maximum and the valve 20 will be at a substantially wide open position, so that substantially all of the pressure drop takes place across the capillary tube 18, and the capillary tube must be sized to allow this flow under these conditions.

As the compressor continues running during the ON cycle, the refrigerated compartment 22 will continue to cool and the temperature of the evaporator 16 will likewise drop. Thus, there is a drop in the total mass flow of refrigerant and the subcooling at the outlet of the condenser 14 will decrease and the valve member 42 tend to move closer to a closed condition. However, the valve will remain open as long as the subcooling condition exists at the condenser outlet.

When the compressor 12 stops for any reason, such as by operation of the thermostat 19 detecting a minimum temperature in the chamber 22, there is no longer any flow of refrigerant into the condenser 14 and the pressure at the outlet will tend to rise as liquid refrigerant continues the flow through the valve 20 and into the capillary tube 18. However, as soon as the pressure reaches a set point which is still within the subcooling range, the valve member 42 will close so that the tip 46 seals off the valve seat 35 to prevent any further flow of refrigerant from the condenser to the evaporator. This ensures that no vapor will enter the evaporator, and prevents heat from being transferred from the condenser to the evaporator as long as the compressor is on the OFF cycle. Since vapor entering the evaporator as a result of the refrigerant's being above the subcooling threshold would decrease the efficiency of the system, the prevention of refrigerant flow during the OFF cycle prevents the heating of the evaporator, and hence the compartment 22, that would otherwise occur if the valve 20 were not present.

Although the pressure within the condenser will continue to drop from cooling of the refrigerant during the compressor OFF cycle, there will still tend to be a substantial back pressure at the discharge side of the compressor when it restarts at the beginning of the next ON cycle, and this back pressure will require substantially higher starting torque from the compressor motor than would otherwise be required if the pressure were allowed to equalize between the condenser and evaporator. This can be overcome by using a high starting torque electric motor for the compressor, and it has been found that the use of capacitor start motors for the compressor will easily provide sufficient starting toque that restarting of the compressor will not be a problem.

After the compressor restarts, because of the pressure differential between the condenser and evaporator as a result of valve 20 being closed, running conditions are more quickly re-established than if the pressure had equalized. The evaporator is reflooded more quickly, thus resulting in a decrease of the run time of the compressor for a given amount of cooling during the ON cycle.

Figure 3:
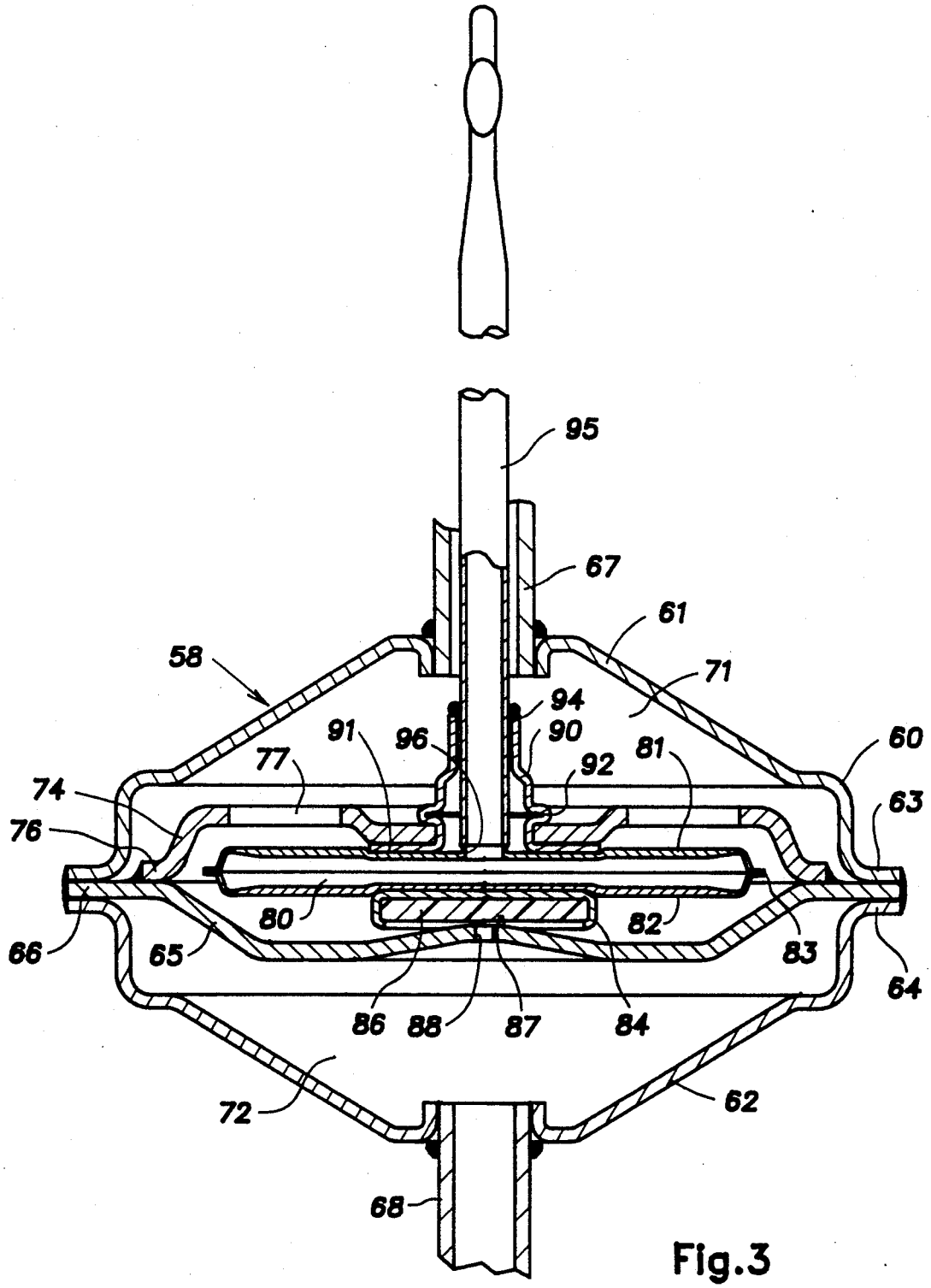
FIG. 3 is a cross-sectional view of an another preferred flow control valve constructed according to the present invention.

Another embodiment of the control valve is shown at 58 in FIG. 3, and it will be understood that this valve is located in the system shown in FIG. 1 in the same position as control valve 20. This control valve includes a housing 60 comprising cup-shaped inlet and outlet members 61 and 62, each having peripheral flanges 63 and 64. Within the housing 60 is located a transverse partition member 65, also having a peripheral flange 66 which is clamped between the flanges 63 and 64 in the form of a sandwich, which may then be brazed and welded around its periphery to provide a unitized sealed housing 60. The inlet member 61 is provided with a central inlet fitting 67 which is connected to the condenser 14, while the lower or outlet member 62 is provided with an outlet fitting 68, which in turn is connected to the capillary tube 18. Then, as control valve 58 is located in the system, it is preferably positioned as shown in FIG. 4 so that the inlet fitting 67 is uppermost and the axial alignment between the fittings 67 and 68 is substantially vertical. The valve should be located at a generally low point in the system to ensure positive liquid flow from the condenser 14 into the inlet fitting 67.

The partition member 65 separates the interior of housing 60 into an inlet chamber 71 between the inlet member 61 and partition 65 and an outlet chamber 72 between the partition 65 and the outlet member 62. Within the inlet chamber 71, a support plate 74 is positioned a spaced distance from the partition 65 and has an outer peripheral edge 76 which is secured by welding or brazing to the flange 66 and partition 65 within the inlet chamber 71. The support plate 74 has a plurality of openings 77 therein to ensure free fluid communication within the chamber 71 on both sides of the support plate 74.

Between support plate 74 and partition 65 is located a movable wall member in the form of upper and lower diaphragm members 81 and 82, which are sealed together around the edges 83 and define a chamber 80 between them. The upper diaphragm member 81 is stationary with respect to the support plate 74, while the lower or movable diaphragm or wall member 82 carries on its lower side a cup 84 secured thereto by welding or brazing, and carrying a valve seal 86 which may be formed of a suitable resilient material such as polytetrafluoroethylene or a suitable rubberlike elastic material which is fully compatible with the refrigerant of the system. The valve seal 86, in turn, is adapted to make contact with the valve seat 87 formed around opening 88 extending through the partition member 65 and providing the sole communication between the inlet chamber 71 and the outlet chamber 72. If it is so desired, the cup 84 or other members can be configured to engage the partition 65 to limit travel of the cup 84 and seal 86 against the valve seat 87 to minimize the effects of cold flow or set on the material forming the seal 86.

To secure the upper diaphragm member 81 in position, it is secured to a flange 91 on a fitting 90, with the flange 91 also being held in position against the lower side of support plate 74 by a bead 92 formed on the fitting 80 above the support plate 94. The upper end of fitting 90 is formed with an open end 94, where it is sealingly secured to the end of a tube 95 which extends upwardly through the inlet fitting 67. At its lower end, tube 95 makes a sealing fit against an opening 96 in the upper diaphragm member 81, so that the interiors of tube 95 and chamber 80 are in full fluid communication but sealed from the inlet and outlet chambers 71 and 72. Thus, the chamber 80 is filled with a second refrigerant in a saturated condition in the same manner as second chamber 44 of control valve 20.

It will thus be seen that the valve of FIG. 3 operates in the same manner as the valve of FIG. 2, in that as long as the conditions of the fluid within the inlet chamber 71 and inlet fitting 67 are at temperatures and pressures above a subcooling level, the valve seal 86 will be in tight engagement with the valve seat 87 to prevent fluid communication between the inlet and outlet chambers 71 and 72, and hence prevent any flow through the valve. As soon as a subcooling condition exists when the system is in operation, such subcooling will reduce the temperature and/ or increase the pressure within the inlet chamber 71, and hence the second chamber 80, and the result will allow the valve seal 86 to move away from the valve seat 87 so that refrigerant will flow through the valve in the same manner as described above.

Although several preferred embodiments of the invention have been shown and described in detail, it is recognized that various modifications and rearrangements may be resorted to without departing from the scope of the invention as defined in the claims.

What is claimed is:

1. A refrigerated cabinet comprising a compartment in said cabinet, a compressor and a condenser mounted on said cabinet, an evaporator in said compartment, a capillary tube connecting said evaporator and said condenser in a closed circuit containing a first refrigerant, a thermostat responsive to the temperature in said compartment for selectively energizing said compressor to maintain the temperature in said compartment within a predetermined range, a flow control valve between said condenser and said capillary tube, said flow control valve having a housing defining a first chamber, an inlet to said first chamber connected to said condenser, an outlet from said first chamber to said capillary tube, said housing being mounted on said cabinet at a low point in the system with said inlet and said outlet fittings being in substantially vertical alignment to insure that only a subcooled liquid flows to said inlet, a valve seat on said housing at said outlet, a movable wall member within said first chamber defining a second chamber, said movable wall member being secured to said housing, a valve member operable by movement of said movable wall member to move to and from said valve seat, said second chamber being filled with a predetermined saturated charge of a second refrigerant whereby said valve member is spaced from said valve seat when the subcooling of said first refrigerant in said first chamber is greater than a predetermined amount and said valve member is moved into engagement with said valve seat when the subcooling of said refrigerant in said first chamber is less than said predetermined amount, engagement of said valve member with said valve seat preventing any flow of said first refrigerant from said inlet to said outlet.

2. A refrigerated cabinet as set forth in claim 1, wherein a portion of said second chamber is in an extension tube extending upward through said inlet toward said condenser.

* * * * *

UNITED STATES PATENT AND TRADEMARK OFFICE

CERTIFICATE OF CORRECTION

PATENT NO. : 5,205,131

DATED : April 27, 1993

INVENTOR(S) : Jerome D. Powlas

It is certified that error appears in the above-identified patent and that said Letters Patent is hereby corrected as shown below:

Column 2, line 44, after "after" insert --a--; and line 60, after "refrigerant" insert --bulb that senses the temperature at some point in the--.

Column 5, line 19, after "temperature," insert --a--; and line 37, delete "sa" and insert --as--.

Column 6, line 7, delete "set" and insert --seat--.

Column 7, line 65, delete "toque" and insert --torque--.

Column 8, line 68, delete "80" and insert --90--.

Signed and Sealed this

First Day of February, 1994

Bruce Lehman

*Attest:*

BRUCE LEHMAN

*Attesting Officer*

*Commissioner of Patents and Trademarks*